US006106101A

United States Patent [19]

Suzuki

[11] Patent Number: 6,106,101

[45] Date of Patent: Aug. 22, 2000

[54] PRINT HEAD ASSEMBLY

[75] Inventor: Shogo Suzuki, Nagoya, Japan

[73] Assignee: Brother Kogyo Kabushiki Kaisha, Nagoya, Japan

[21] Appl. No.: 09/094,698

[22] Filed: Jun. 15, 1998

[30] Foreign Application Priority Data

Jul. 25, 1997 [JP] Japan ..... 9-199604

[51] Int. Cl.[7] ..... B41J 3/04

[52] U.S. Cl. ..... 347/40; 347/43

[58] Field of Search ..... 347/40, 41, 43, 347/12

[56] References Cited

U.S. PATENT DOCUMENTS 5,880,749 3/1999 Kikkawa et al. ..... 347/40

5,943,072 8/1999 Robert et al. ..... 347/41

5,956,056 9/1999 Kaneko et al. ..... 347/43

*Primary Examiner*—N. Le

*Assistant Examiner*—Lamson D. Nguyen

*Attorney, Agent, or Firm*—Oliff & Berridge, PLC

[57] ABSTRACT

A print head assembly having at least two print heads each having at least one nozzle for ejecting ink toward a print medium and being movable in a scanning direction substantially orthogonal to a conveyance direction of the print medium, is disclosed. The print heads are arranged in the scanning direction in such a manner that print time from at least one of the print heads is different from print time of at least one other print head. The nozzle interval between an adjacent pair of print heads has a value that is differentiated from the product of any natural number and the inverse number of a resolution, by, for example, adding to or subtracting the inverse number of the product of the resolution and a natural number other than 1, wherein the natural number is the number of print heads.

16 Claims, 9 Drawing Sheets

HEAD INTERVAL=1/300×1+(1/(300×4))

HEAD INTERVAL=1/300×1-(1/(300×4))

HEAD INTERVALS ARE DIFFERENT FROM EACH OTHER.

PRINT HEAD ASSEMBLY

BACKGROUND OF THE INVENTION

1. Field of Invention

The invention relates to a print head assembly capable of printing by scanning a print head in directions substantially orthogonal to the print medium conveyance direction.

2. Description of Related Art

Among well-known printer apparatuses for forming a predetermined print image on a print medium is an ink jet type printer apparatus having a print head that ejects ink to a recording sheet by driving piezoelectric elements through the application of a drive voltage thereto. In such an ink jet type printer apparatus, every time a recording sheet is conveyed, the print head is scanned in a direction substantially orthogonal to the conveying direction of the recording sheet and, at the same time, ink is ejected from nozzles at predetermined print times while the position of the print head being scanned is detected by an encoder device, or the like. Through this operation, the ink jet type printer apparatus is able to perform printing in a band unit.

For color printing, an ink jet type printer apparatus is equipped with print heads corresponding in number to different color inks, for example, black, cyan, magenta, yellow, and the like, that are arranged in the scanning direction. The nozzle intervals between the print heads (that is, intervals between nozzles of the print heads in the scanning direction) are set to a value obtained by multiplying the inverse number of the resolution by a natural number.

FIG. 9 shows an example wherein the resolution is 300 dpi and four print heads corresponding to black (K), cyan (C), magenta (M) and yellow (Y) are arranged so that the nozzle intervals between the print heads become a product of the inverse number (1/300 inch) of the resolution and a natural number (1 in the arrangement in FIG. 9). This arrangement makes it possible to position the nozzles of the print heads precisely at positions (print timing positions) at which dots are to be placed at that resolution (300 dpi) in the scanning direction of the print heads. Therefore, by outputting print timing signals from the encoder device to the print heads at, for example, every print timing position, a predetermined color print image can readily be formed.

However, when a plurality of colors need to be printed using the print head arrangement in which the nozzle intervals between the print heads are equal to a product of a natural number and the inverse number of the resolution, the print heads corresponding to the four colors, eject ink simultaneously at the same print time as indicated in FIG. 9. For example, if the four colors are required at a given print time, all the four print heads simultaneously eject ink. Simultaneous ink ejection from all the print heads at a print time requires a high level of drive voltage to the print heads at that print time. Such a peaky voltage requirement causes a significantly large load on the power source.

SUMMARY OF THE INVENTION

Accordingly, it is an object of the invention to provide a print head assembly that improves efficiency in power consumption for printing operations through achieving smooth or relatively regular changes in drive power required for ink ejection from print heads by eliminating simultaneous ink ejection from all the print heads at the same print time.

According to the invention, there is provided a print head assembly including at least two print heads each having at least one nozzle for ejecting ink toward a print medium and being movable in a scanning direction substantially orthogonal to a conveyance direction of the print medium. The print heads are arranged in the scanning direction in such a manner that the print time of ink ejection from at least one of the print heads is different from the print time of at least one other print head.

With this structure, the print head assembly of the invention eliminates simultaneous ink ejection from all of the print heads at the same print time. That is, one of the print heads ejects ink at print times that are different from the print times of other print heads. Therefore, drive power for driving the print heads is consumed dispersedly at print times. Consequently, the print head assembly eliminates the need for a great drive power required at a time by simultaneous ink ejection from, for example, all the print heads at the same print time. That is, the print head assembly achieves smooth or relatively regular changes in drive power consumption, thereby reducing the load on the power source.

In the print head assembly of this invention, a nozzle interval between an adjacent pair of print heads may have a value that is different from a product of the inverse number of a resolution and any natural number. During scanning using this print head arrangement of two print heads, for example, one of the print heads comes to a print timing position when the other print head is not at any print timing position. Therefore, it is ensured that the print times of one of the print heads are shifted from the print times of the other print head.

The nozzle interval between an adjacent pair of print heads may have a value that is differentiated from the product of a natural number and the inverse number of the resolution, by the inverse number of the product of the resolution and a natural number other than 1. By setting the nozzle interval between an adjacent pair of print heads to such a value, the adjacent print heads are disposed apart from each other by an interval determined by adding to or subtracting from the inverse number of the resolution, a shift value obtained by dividing the inverse number of the resolution by a natural number other than 1. It is possible to arrange all of the print heads at the set nozzle interval. Therefore, simply by outputting print timing signals to the print heads at times corresponding to the shift value, printing can be performed at predetermined print timing positions while the print times of print heads are shifted. Consequently, it becomes possible to reliably shift the print times between at least two print heads by using a simplified control method, and to achieve smooth or relatively regular changes in drive power consumption.

The aforementioned natural number other than 1 may be a number equal to the number of the print heads. In this arrangement, the adjacent print heads are disposed apart from each other by an interval determined by adding to or subtracting from the inverse number of the resolution, a shift value obtained by dividing the inverse number of the resolution by the number of print heads. Therefore, simply by outputting print timing signals to the print heads at times corresponding to the shift value, printing can be performed at predetermined print timing positions while the print times of the individual print heads are shifted from one print head to another. Consequently, it becomes possible to reliably shift the print times of the individual print heads from one print head to another by using a simplified control method, and to further improve the smoothness or regularity of changes in drive power consumption.

In the print head assembly of the invention, the print heads may include at least three print heads that each eject color ink that is different from one print head to another. In general, in a print head arrangement wherein the nozzle interval between print heads is set to a product of a natural number and the inverse number of the resolution, the incidence of simultaneous ink ejection from different print heads at the same print time increases as the number of print heads increases. Therefore, in a print head arrangement of at least three print heads of different color ink, drive power consumption changes can be made smooth or relatively regular by differentiating the print times of the individual print heads from one print head to another.

The nozzle intervals between each adjacent pair of print heads of the three print heads may be equal. By arranging the different color ink print heads equidistantly, the design of the print head assembly can be made easier.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Figure 1:
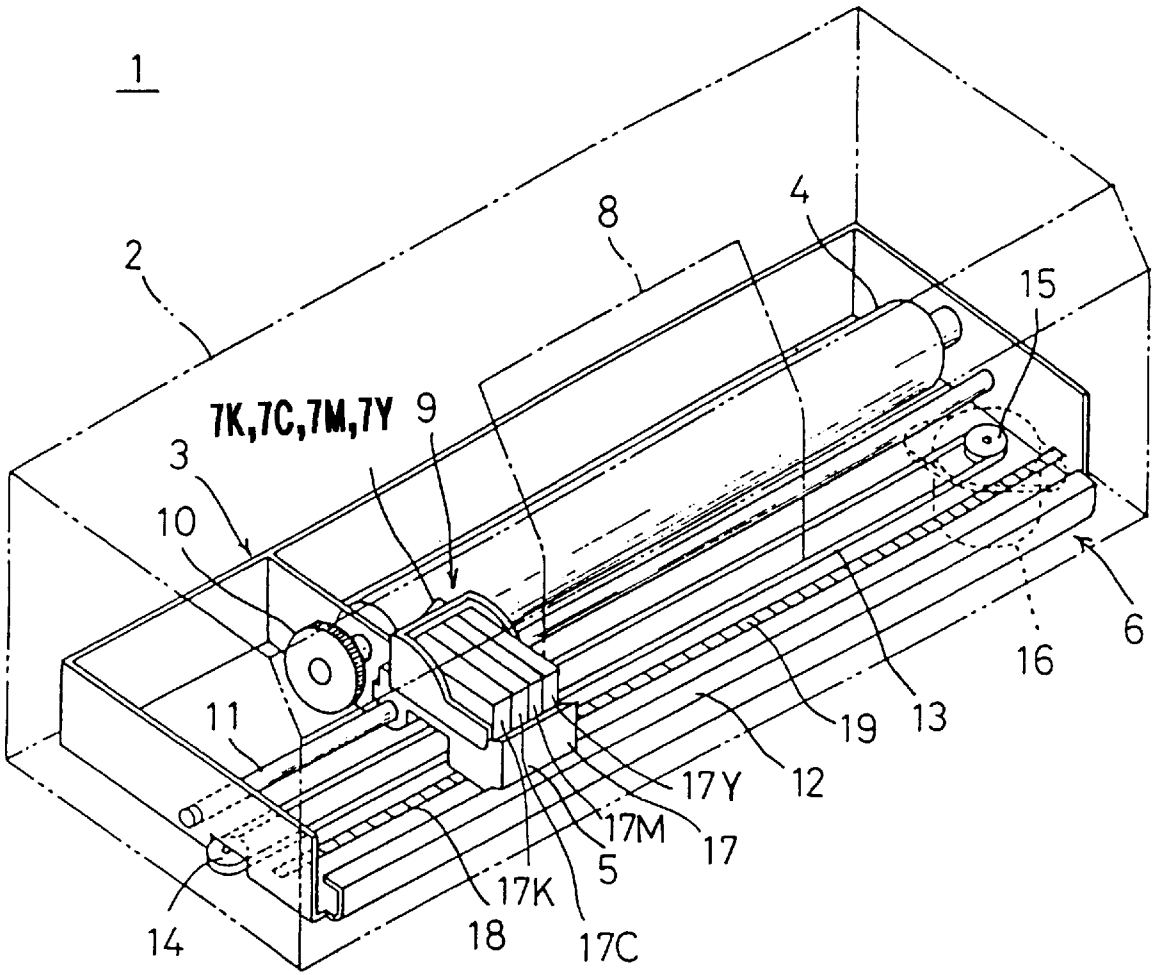
FIG. 1 is a perspective view of portions of a preferred embodiment of the printer apparatus of the invention.

A preferred embodiment of the invention will be described in detail hereinafter with reference to the accompanying drawings. FIG. 1 is a perspective view of portions of a printer apparatus according to the preferred embodiment of the invention. The embodiment is formed as an ink jet type printer apparatus 1 that ejects ink from print heads. The ink jet type printer apparatus 1 has a body frame 3 disposed in a body cover 2 indicated by broken lines. Disposed in the body frame 3 are a platen 4, a carriage drive mechanism 6 for driving a carriage 5, and an ink ejecting mechanism 9 for ejecting ink from print heads 7 toward a sheet 8, that is, a print medium.

The platen 4 is rotatably supported at its both ends by the body frame 3. A platen gear 10 is provided on a left-side end of the platen 4. The platen gear 10 is driven by a feeding motor 35 (see FIG. 2) through transmission by a gear train (not shown) so that the platen 4 conveys the recording sheet 8 in a predetermined direction.

The carriage 5 is movably supported at a portion thereof closer to the platen 4 by a guide rod 11, and movably supported at a portion thereof relatively remote from the platen 4 by a guide rail 12. The guide rod 11 is supported at its both ends by the body frame 3. The guide rail 12 forms a portion of the body frame 3.

The carriage 5 is fixed at its lower portion to a predetermined site in a belt 13. The belt 13, extending parallel to the guide rod 11 and the guide rail 12, is disposed on pulleys 14, 15 disposed at opposite side ends of the body frame 3. A pulley 15 is provided on a drive shaft of a carriage motor 16 (e.g., a stepping motor). Driven by the carriage motor 16, the carriage 5 is moved along the guide rod 11 and the guide rail 12, that is, scanned in directions substantially orthogonal to the conveyance direction of the sheet 8.

The carriage 5 carries thereon the print heads 7 and four ink cartridges 17K, 17C, 17M, 17Y containing a black ink, a cyan ink, a magenta ink and a yellow ink, respectively. Although not clearly shown in FIG. 1, the print heads 7 are four print heads 7K, 7C, 7M, 7Y corresponding on a one-to-one basis to the four ink cartridges 17K, 17C, 17M, 17Y. The four print heads 7K, 7C, 7M, 7Y are aligned in the scanning directions of the carriage 5. By driving piezoelectric elements and the like, the print heads 7K, 7C, 7M, 7Y eject inks supplied from the ink cartridges 17K, 17C, 17M, 17Y, from nozzles onto the sheet 8. Although not shown in FIG. 1, each of the print heads 7K, 7C, 7M, 7Y has a plurality of nozzles that are arranged in the sheet conveyance direction.

An encoder scale 18 extends in the scanning directions of the carriage 5. The encoder scale 18 has optically readable slits 19 that are distributed at a rate of 300 slits per inch in the direction of length of the encoder scale 18.

The carriage 5 is provided with an encoder device 20 (see FIG. 2) that reads slits 19 of the encoder scale 18 and generates an encoder signal corresponding to the moving speed of the carriage 5, that is, an encoder signal being a number of pulses corresponding to the number of slits 19 at pulse periods corresponding to the intervals between slits 19. The encoder device 20 has, for example, a photo-coupler made up of two light-emitting elements and two light-receiving elements. The encoder device 20 is designed so that there is a ¾ phase difference between the two pairs of light-emitting and light-receiving elements. Based on the phase difference between the pulses output from the two light-receiving elements, the scanning directions of the carriage 5 (forward and backward direction) can be detected.

Figure 2:
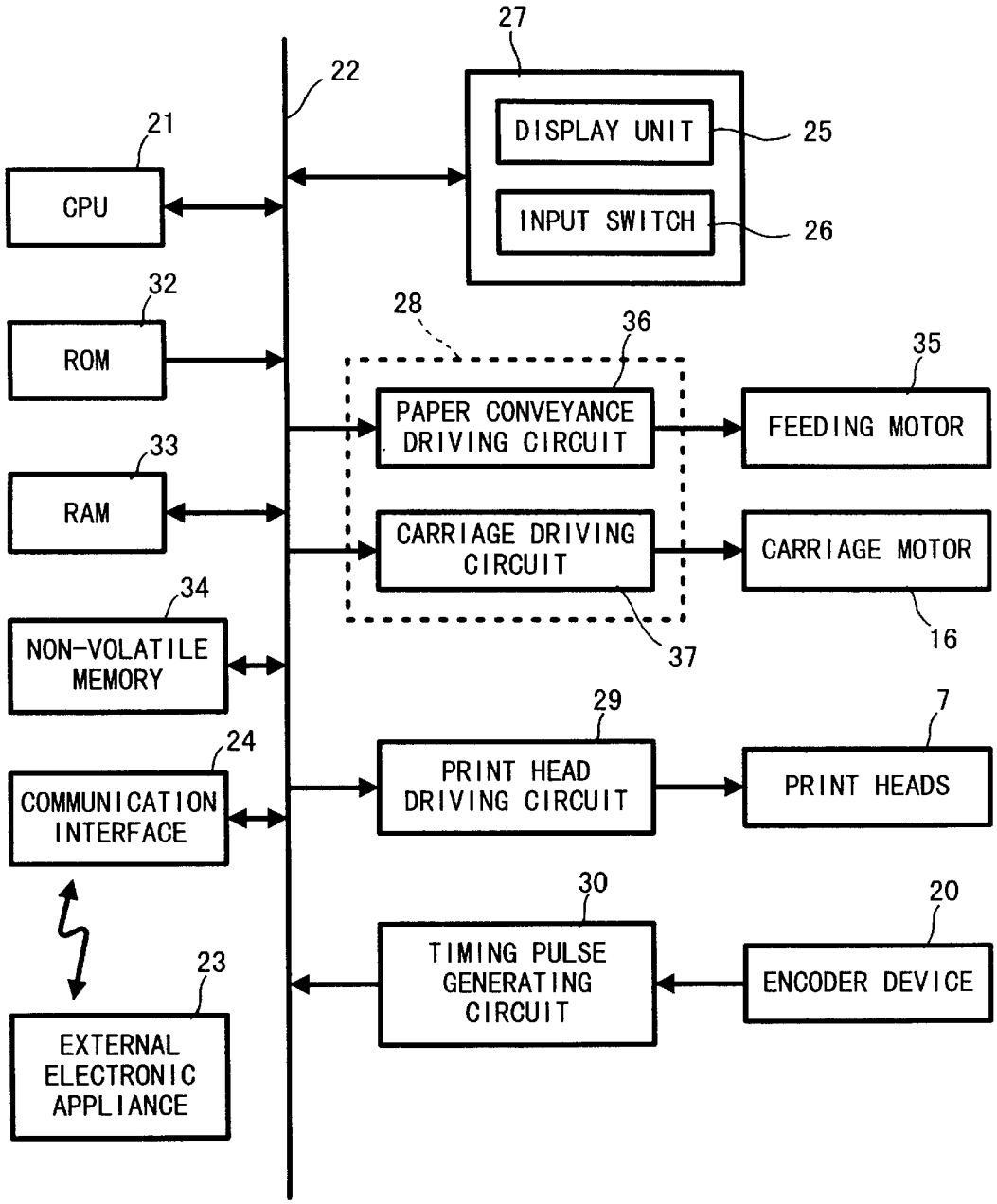
FIG. 2 is a block diagram of a control system of the ink jet type printer apparatus.

FIG. 2 shows a block diagram of a control system of the ink jet type printer apparatus 1. Referring to FIG. 2, a CPU 21 is connected, via buses 22, such as a data bus, an address bus and the like, to various components, for example: a communication interface 24 for the exchange of various data with an external electronic appliance 23; an operating panel 27 having an input switch 26 and a display unit 25 formed by a liquid crystal display, LED display lamps or the like; a motor driving circuit 28 for driving print-related motors and the like, the motor driving circuit 8 including a paper conveyance driving circuit 36 for driving the feeding motor 35 and a carriage driving circuit 37 for driving the carriage motor 16; a print head driving circuit 29 for driving the print heads 7; a timing pulse generating circuit 30 for generating various timings based on the signals from the encoder device 20; a ROM 32; a RAM 33; a non-volatile memory (for example, EEPROM) 34; and the like.

The ROM 32 stores a reception control program for receiving image data, control data, and the like, from the external electronic appliance 23, a control head program for driving and controlling the motor driving circuit 28, the print head driving circuit 29, and the like, a program for controlling the display or input in the operating panel 27, and the like. The RAM 33 has various storage areas, such as a buffer for storing image data, control data, and the like, received from the external electronic appliance 23, various memories and buffers for print control, and the like. The non-volatile memory 34 stores various values that need to be retained even after the apparatus body is powered off, such as various set values, and the like.

Figure 3:
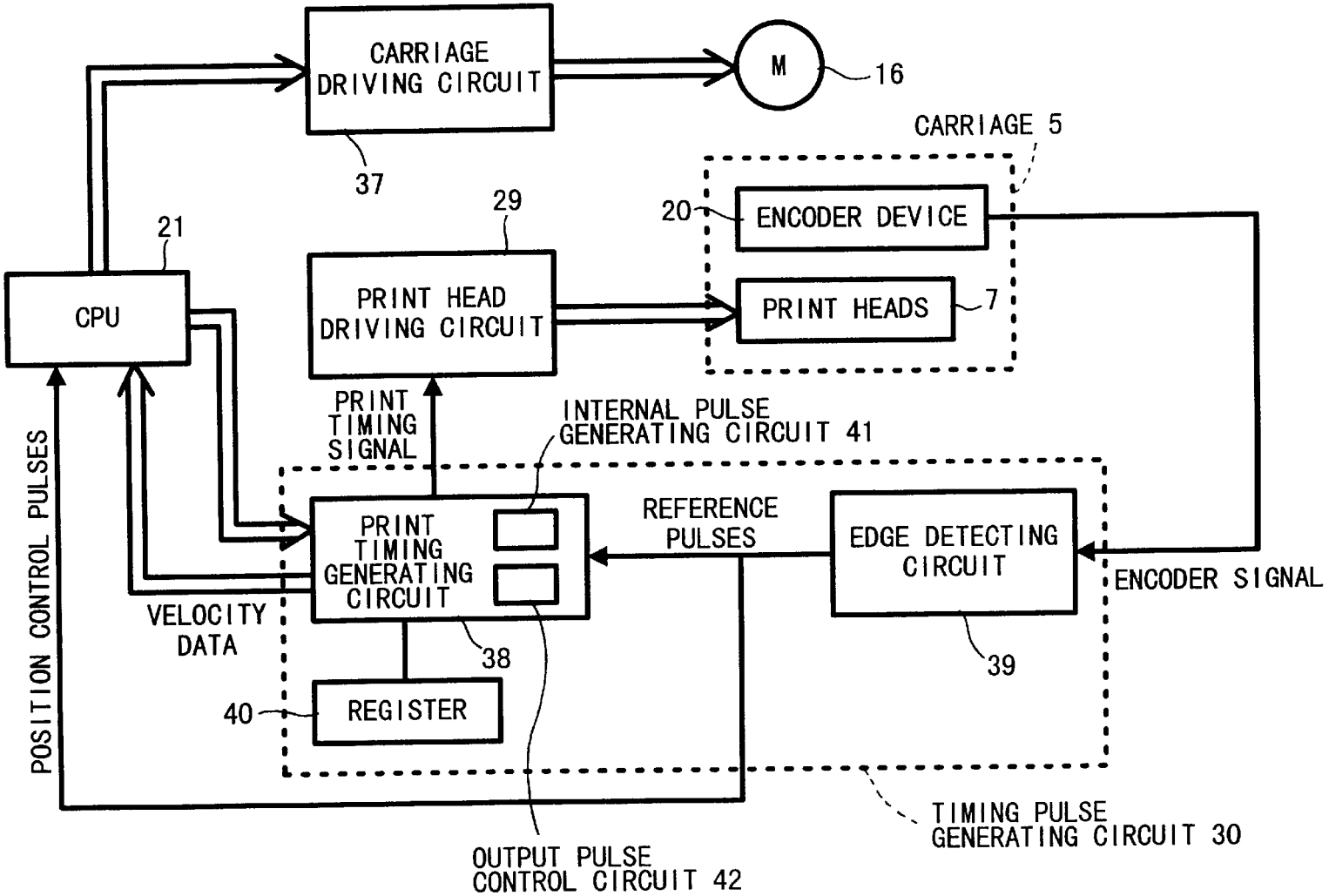
FIG. 3 is a lock diagram of a control system for scanning the print heads and performing printing at predetermined times, the control system being a portion of the control system shown in FIG. 2.

FIG. 3 is a detailed block diagram of a portion of the control system shown in FIG. 2 for scanning the print heads 7 for printing at predetermined times. Referring to FIG. 3, the timing pulse generating circuit 30 is provided as a gate array that includes a print timing generating circuit 38 and an edge detecting circuit 39. The edge detecting circuit 39 detects a rising edge of each encoder signal output from the encoder device 20, and outputs a reference pulse at every edge detection time. The print timing generating circuit 38 outputs a print timing signal based on reference pulses from the edge detecting circuit 39.

The CPU 21 receives velocity data (a count value of the pulse widths of the encoder signals) from the print timing generating circuit 38 and, based on the velocity data, calculates a pulse width of a drive signal that prescribes a scanning speed of the carriage 5. The drive signal is output to the carriage driving circuit 37 for the carriage motor 16. Furthermore, the CPU 21 receives position control pulses (reference pulses) from the edge detecting circuit 39 in order to calculate a present position of the carriage 5. The CPU 21 also writes data that designates an output pulse select signal and the like, into a register 40.

Print timing signals, that is, timing pulses outputted from the print timing generating circuit 38, are input to the print head driving circuit 29. In accordance with the times given by print timing signals, the print head driving circuit 29 generates print head driving pulses that meet the pulse width and voltage requirements for driving the print heads 7 on the basis of the print data provided by the CPU 21. In response to the print head drive pulses, the print heads 7 eject ink onto the sheet 8 at the designated times.

Figure 4:
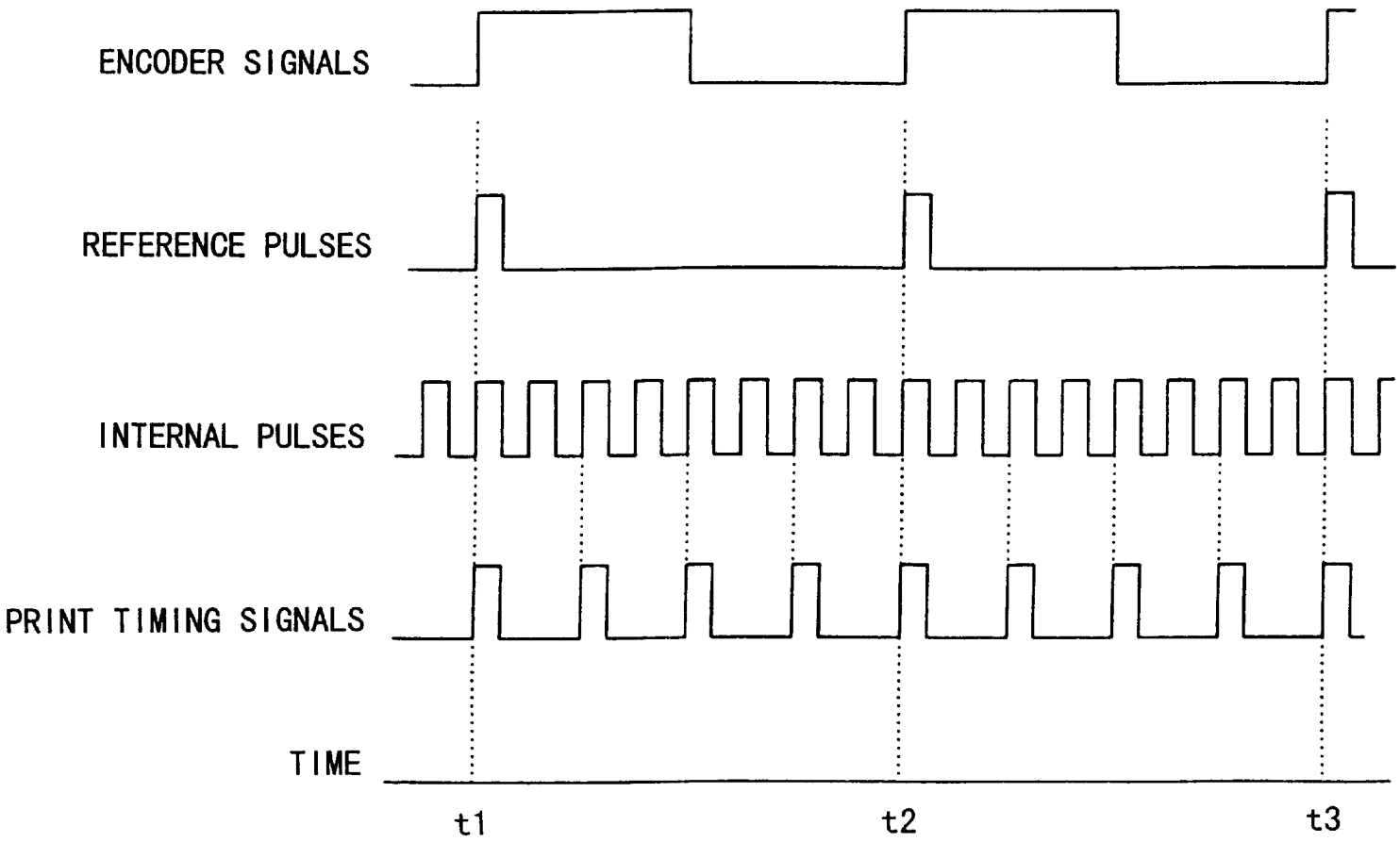
FIG. 4 is a timing chart of the signals used by the control system shown in FIG. 3.

FIG. 4 shows a timing chart of the signals used in the control system shown in FIG. 3. With reference to FIG. 4, the manner in which the print timing generating circuit 38 generates print timing signals will be described in detail. The encoder signals, output from the encoder device 20 as described above, have a period corresponding to the scanning speed of the carriage 5. The edge detecting circuit 39 detects the leading edge of encoder signals, and correspondingly generates reference pulses. The print timing generating circuit 38 has an internal pulse generating circuit 41 that generates a plurality of internal pulses during each period between the rise of a reference pulse and the rise of the next reference pulse. The print timing generating circuit 38 also has an output pulse control circuit 42 that performs control such that one print timing signal is generated every time a predetermined number of internal pulses are counted.

Therefore, using the internal pulse generating circuit 41 and the output pulse control circuit 42, the print timing generating circuit 38 is able to divide a reference pulse into a plurality of finer pulses (internal pulses), and output a print timing signal of any desired pulse period, based on the divided pulses. For example, in the printer apparatus where the density of the encoder slits 19 is 300 per inch, a resolution of 300 dpi is provided in a case where the reference pulses based on the encoder signals are directly used as print timing signals. However, in a case where the internal pulse generating circuit 41 generates 8 internal pulses during every period of the reference pulses, and where the output pulse control circuit 42 performs control such that one print timing signal is generated every time two internal pulses are counted, as indicated in FIG. 4, the print timing signals generated provide a resolution of 1200 dpi= 300 dpi×8 (internal pulses)×½ (count). The print timing signals generated may be used to provide predetermined print times for the four print heads 7K, 7C, 7M, 7Y while the resolution remains the same (300 dpi), as described below.

With the above-described manner of generating print timing signals being employed, the four print heads 7K, 7C, 7M, 7Y in this embodiment are arranged so as to avoid synchronization of print times of the individual print heads 7K, 7C, 7M, 7Y ejecting ink from their nozzles.

Figure 5:
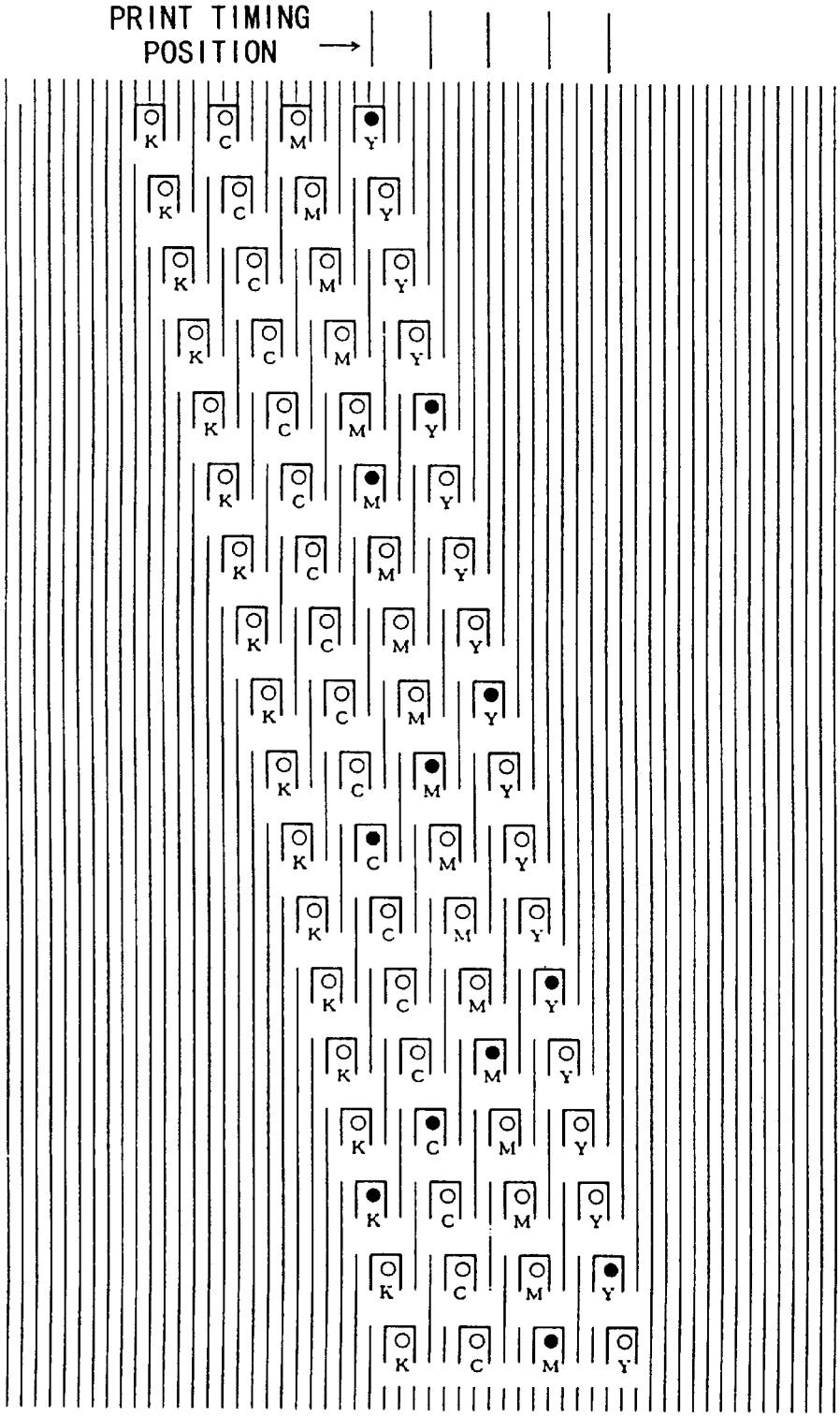
FIG. 5 is a chart illustrating, in a stepwise manner, the scanning of the print heads that are arranged at a predetermined nozzle interval.

An example of the print head arrangement will be described with reference to FIGS. 5 through 8. FIG. 5 is a chart illustrating, in a stepwise manner, the scanning of the print heads 7K, 7C, 7M, 7Y that are arranged so that the nozzle interval between each adjacent pair of print heads 7 becomes equal to a value obtained by adding the product of the inverse of the resolution and a natural number n, to the inverse of the product of the resolution and a natural number other than 1 (e.g., the number of the print heads 7). For example, in FIG. 5, the nozzle interval=$\frac{1}{300}\times1+(1/(300\times4))$.

In FIGS. 5 through 8, nozzles that eject ink at predetermined print timing positions are indicated by "•", and nozzles that do not eject ink are indicated by "o". However, it should be noted that, in this embodiment, each print head has a plurality of nozzles that are arranged in the sheet conveying direction, as described above. Furthermore, although in FIGS. 5 through 8, the natural number n is 1 for the purpose of simple illustration, the natural number n for the print heads 7K, 7C, 7M, 7Y in this embodiment may be set to 256 based on design considerations. Further, in FIGS. 5 through 8, the illustration has been made on the basis of a resolution of 300 dpi.

In FIG. 5, given the resolution of 300 dpi, the interval between the print heads 7 becomes $\frac{1}{300}\times1+(1/(300\times4))$ inch. When the print heads 7 thus arranged are scanned together with the carriage 5 over the sheet 8, the scanning is performed so that the nozzles of two or more of the print heads 7 do not simultaneously print at the same print timing position, but so that the nozzle of only one of the print heads 7 prints at a print timing position at any print time, as is apparent from FIG. 5. That is, if the nozzle interval between the print heads 7K, 7C, 7M, 7Y is set to a value different from the multiple of the inverse number ($\frac{1}{300}$ inch) of the resolution by any natural number (in FIG. 5, the natural number n=1, so that the natural number multiple of the inverse number of the resolution corresponds to the interval between print timing positions), no adjacent pair of print heads 7 will simultaneously print at the same print timing position. Thus, when the nozzle of a given print head 7 is at a print timing position, the nozzles of the print heads 7 next to that print head 7 do not print at that print timing position. Therefore, it is ensured that the print time of any one of the print heads 7 is different from the print time of the print heads 7 next thereto.

In the example indicated in FIG. 5, the inverse number of a product of the resolution and the number of print heads 7

(=4), that is, (1/(300×4) inch), is added to the inverse number of the resolution, that is, (1/300 inch). In other words, the print head interval is differentiated from the inverse number of the resolution by adding to it a value obtained by dividing the inverse number of the resolution by the number of print heads. Therefore, during the scanning of the print heads 7 arranged as indicated in FIG. 5, the nozzles of two or more of the print heads 7 do not simultaneously print at the same print timing position, but the nozzle of only one of the print heads 7 prints at a print timing position at any one print time.

Therefore, printing can be performed at predetermined print timing positions while the print times of the individual print heads 7K, 7C, 7M, 7Y are shifted from one print head to another. This is accomplished simply by, as indicated in FIG. 4, the internal pulse generating circuit 41 dividing the reference pulses based on the encoder signals, and thereby generating internal pulses, and by the output pulse control circuit 42 outputting a print timing signal to one of the print heads 7 at every time that is set on the basis of the internal pulses corresponding to the aforementioned differential value (1/(300×4) inch). Consequently, the drive power for driving the print heads 7 is consumed dispersedly at the times at which any one of the print heads 7 ejects ink. In this manner, the drive power consumption changes are made smooth or relatively regular, thereby reducing the load on the power source and enabling print processing with efficient power consumption.

Figure 6:
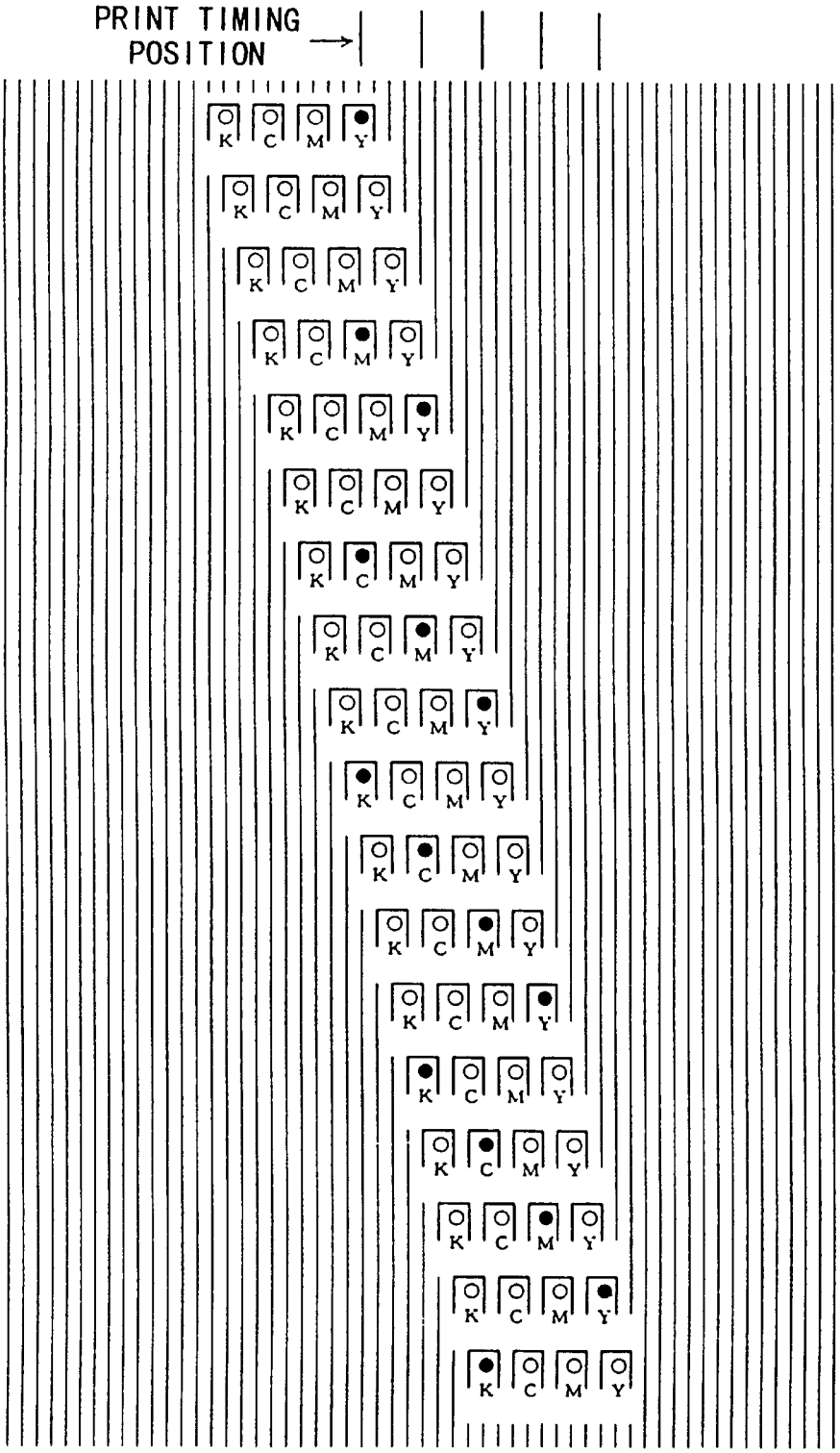
FIG. 6 is a chart illustrating, in a stepwise manner, in the scanning of the print heads that are arranged on the basis of predetermined nozzle interval setting different from the interval setting indicated in FIG. 5.

FIG. 6 is a chart similar to that in FIG. 5, illustrating an arrangement wherein the nozzle interval between each adjacent pair of the print heads 7 is set to a value obtained by subtracting the inverse number of the product of the resolution and a natural number other than 1 (e.g., the number of print heads 7) from the product of the inverse number of the resolution and a natural number n.

That is, the interval between the print heads 7 in the arrangement indicated in FIG. 6 becomes 1/300×1−(1/(300×4)) inch. With this arrangement of the print heads 7K, 7C, 7M, 7Y, scanning is performed so that the nozzles of two or more of the print heads 7 do not simultaneously print at the same print timing position, but so that the nozzle of only one of the print heads 7 prints at a print timing position at any one print time, as in the arrangement indicated in FIG. 5.

In FIG. 5, the print head interval is differentiated from the inverse number of the resolution (1/300 inch) by the addition of the inverse number of the product of the resolution and the number of print heads 7 (1/(300×4) inch), whereas in the arrangement indicated in FIG. 6, the print head interval is differentiated from the inverse number of the resolution (1/300 inch) by the subtraction of the inverse number of the product of the resolution and the number of print heads (1/(300×4) inch). Therefore, the arrangement of the print heads 7 indicated in FIG. 6 also makes it possible to perform printing at predetermined print timing positions while shifting the print times of the individual print heads 7K, 7C, 7M, 7Y from one print head to another, as in the arrangement in FIG. 5. Consequently, the drive power for driving the print heads 7 is consumed in a dispersed manner. In this manner, the drive power consumption changes are made smooth or relatively regular, thereby reducing the load on the power source.

Figure 7:
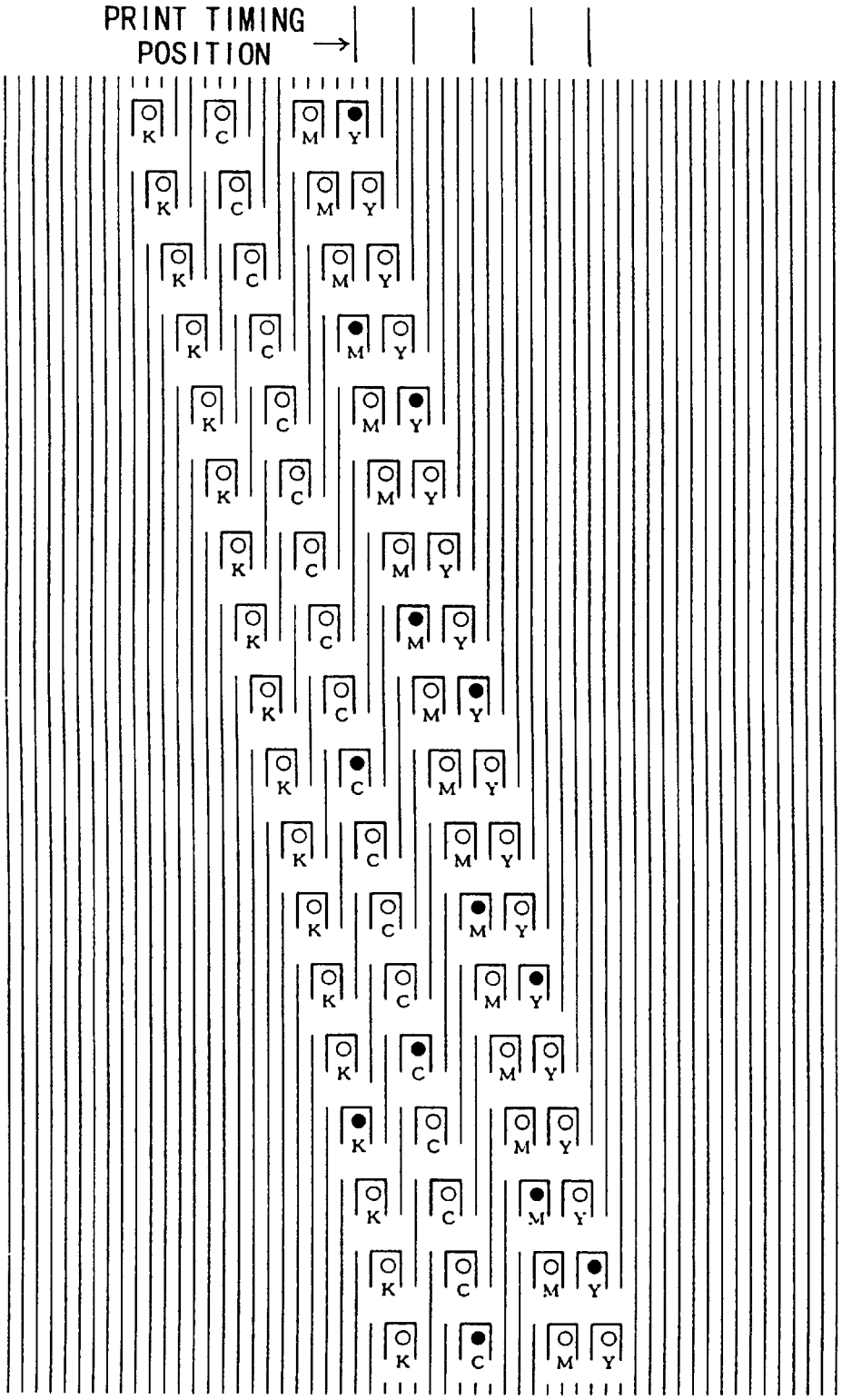
FIG. 7 is a chart illustrating, in a stepwise manner, in the scanning of the print heads that are arranged on the basis of predetermined nozzle interval setting different from the interval setting indicated in FIG. 5.

FIG. 7 is a chart illustrating an arrangement of the print heads 7K, 7C, 7M, 7Y, where the nozzle intervals between the print heads 7 are set to different values each of which is different from the product of the inverse number of the resolution and any natural number. In the arrangement in FIG. 7, the nozzle interval between the black print head 7K and the cyan print head 7C is set to a value obtained by adding the inverse number of the product of the resolution and the number of print heads 7 (i.e., 4) to the inverse number of the resolution, that is, (1/300+(1/(300×4) inch). The nozzle interval between the magenta print head 7M and the yellow print head 7Y is set to a value obtained by subtracting the inverse number of the product of the resolution and the number of print heads 7 from the inverse number of the resolution, that is, (1/300−(1/(300×4) inch). The nozzle interval between the cyan print head 7C and the magenta print head 7M is set to a value obtained by adding the inverse number of the product of the resolution and 2, to the inverse number of the resolution, that is, (1/300+(1/(300×2) inch).

As is apparent from FIG. 7, during the scanning of the print heads 7K, 7C, 7M, 7Y arranged as described above, the nozzles of two or more of the print heads 7 do not simultaneously print at the same print timing position, but the nozzle of only one of the print head 7 prints at a print timing position at a given print time. That is, printing is performed at predetermined print timing positions while the print timing of the individual print heads 7K, 7C, 7M, 7Y is shifted from one print head to another. Therefore, the drive power for driving the print heads 7 is consumed in a dispersed manner. In this manner, the drive power consumption changes are made smooth or relatively regular, thereby reducing the load on the power source. In the arrangement in FIG. 7, however, the sequence of the print heads 7 arriving at print timing positions becomes complicated in comparison with the sequences in the arrangements indicated in FIGS. 5 and 6. Therefore, in terms of ease in design, it is preferred that the intervals between print heads 7K, 7C, 7M, 7Y be equal, as in FIGS. 5 and 6.

Figure 8:
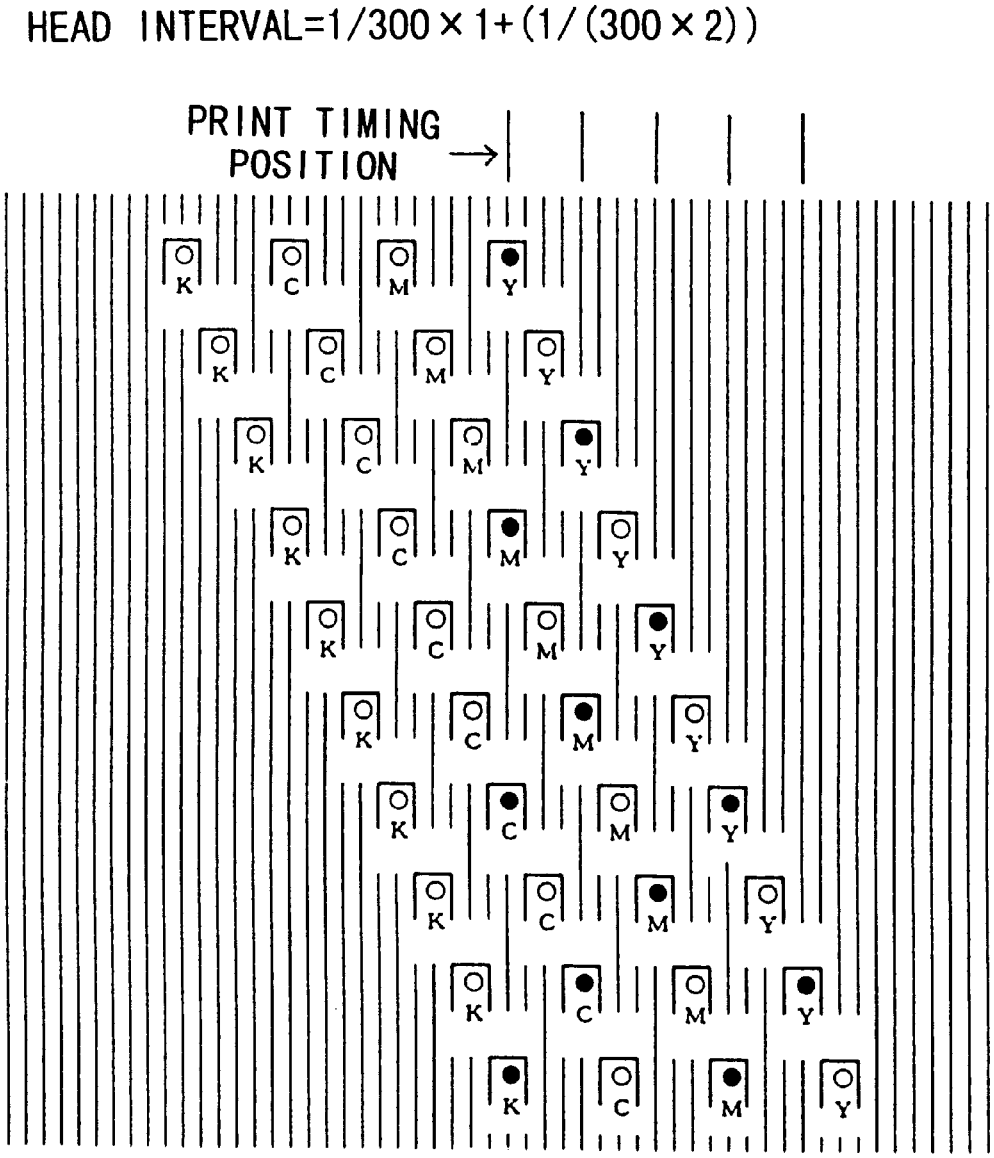
FIG. 8 is a chart illustrating, in a stepwise manner, in the scanning of the print heads that are arranged on the basis of predetermined nozzle interval setting different from the interval setting indicated in FIG. 5.
Figure 9:
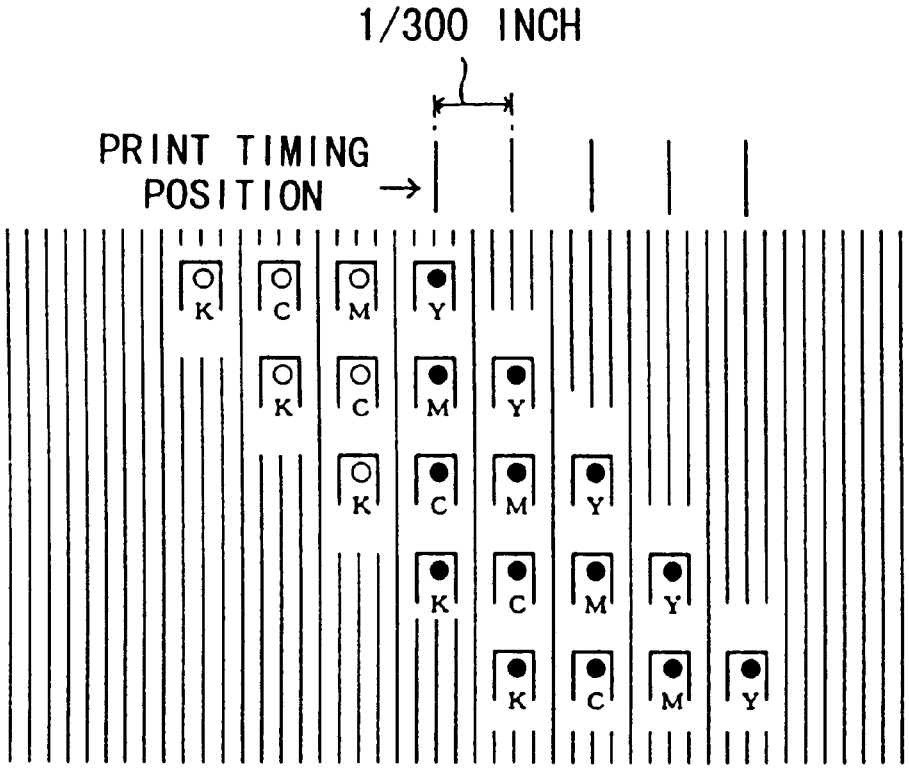
Fig.9 PRIOR ART
FIG. 9 is a chart illustrating the nozzle intervals between print heads according to the conventional art.

FIG. 8 is a chart illustrating still another example arrangement wherein the nozzle interval between each adjacent pair of the print heads 7K, 7C, 7M, 7Y is set to a value obtained by adding the product of a natural number and the inverse number of the resolution, to the inverse number of the product of the resolution by a natural number other than 1 (in this arrangement, this natural number is different than the number of print heads 7). More specifically, in the arrangement in FIG. 8, the nozzle interval between the print heads 7K, 7C, 7M, 7Y is set to a value obtained by adding the inverse number of the product of the resolution and 2, to the inverse number of the resolution, that is, (1/300+(1/(300×2) inch).

As can be seen from the chart of FIG. 8, scanning is performed so that two of the print heads 7 simultaneously print at the same print timing positions at a given print time, but not all of the four print heads 7 simultaneously print at the same print timing positions. That is, ink is not ejected from all of the print heads 7 simultaneously at any given print time, thus, ink ejection from any one of the print heads 7K, 7C, 7M, 7Y is performed at print times that are different from the print times or ink ejection from at least one other print head. Therefore, the drive power for driving the print heads 7 is consumed dispersedly at print times.

In other words, a plurality of print heads (the four print heads 7K, 7C, 7M, 7Y in FIG. 8) are divided into at least two groups (in FIG. 8, two groups, that is, the group of 7C and 7Y, and the group of 7K and 7M). The print heads in the same group eject ink simultaneously at some print times, whereas print heads of different groups always eject ink at different print times. This also applies to an arrangement of a plurality of groups of print heads where the print heads of each group are disposed side by side. Also in this arrangement, the nozzle interval between the print heads of each group is set to the product of the inverse number of the resolution and a natural number, whereas the nozzle interval between print heads belonging to different groups is set to a value that is different from the product of the inverse number of the resolution and any natural number.

The print head arrangements according to this embodiment, eliminate the need for a large drive power which would be required at the time of simultaneous ink ejection from, for example, all the print heads 7 at the same print time. That is, the embodiment achieves smooth or relatively regular changes in drive power consumption, thereby reducing the load on the power source. Consequently, print processing can be performed with efficient power consumption.

With a print head arrangement wherein at least one of the nozzle intervals between the print heads 7K, 7C, 7M, 7Y is set to a value that is different from the product of the inverse number of the resolution and any natural number, ink ejection from any one of the print heads 7K, 7C, 7M, 7Y is performed at print times that are different from the print times from at least one other print head. Therefore, power consumption changes in color printing can be made smooth or relatively regular. Consequently, color print processing can be performed with efficient power consumption.

Although the foregoing embodiment employs the four print heads 7K, 7C, 7M, 7Y, the invention is not limited to such a structure. The invention is applicable to any print head assembly that has at least two print heads, for example, a print head assembly having three print heads of cyan, magenta, and yellow color inks.

As understood from the foregoing description, the printer apparatus of the invention is able to disperse the drive power consumption for driving the print heads over a plurality of print times. In this manner, the drive power consumption changes can be made smooth or relatively regular, thereby reducing the load on the power source and enabling print processing with efficient power consumption.

Furthermore, the printer apparatus is able to reliably shift the print time of a print head from the print times of other print heads. Therefore, the drive power consumption for driving the print heads will be reliably disposed over a plurality of print times. Consequently, the load on the power source can be reliably reduced.

Further, according to the foregoing embodiment, the nozzle interval between an adjacent pair of print heads has a value that is differentiated from the product of a natural number and the inverse number of the resolution, by the inverse number of the product of the resolution and a natural number other than 1. Therefore, the printer apparatus is able to reliably shift the print times of print heads while using a simplified control method, and therefore achieve smooth or relatively regular changes in drive power consumption. Consequently, the load on the power source can be reliably reduced.

Further, if the natural number other than 1 is a number equal to the number of print heads, the printer apparatus is able to reliably shift the print time of the individual print heads from one print head to another while using a simplified control method, and therefore improve the smoothness or regularity of changes in drive power consumption. Consequently, the load on the power source can be further reduced.

The print head assembly is also able to achieve smooth or relatively regular changes in drive power consumption in color printing that employs at least three print heads for ejecting color inks that are different from one print head to another. Therefore, color print processing can be performed with efficient power consumption.

If the nozzle intervals between each adjacent pair of the three color ink print heads are equal, the print head assembly is able to perform color print processing with efficient power consumption while employing a simplified structure.

It is to be understood that the invention is not restricted to the particular forms shown in the foregoing embodiment. Various modifications and alterations can be made thereto without departing from the scope of the invention encompassed by the appended claims.

What is claimed is:

1. A print head assembly comprising:

at least two print heads each having at least one nozzle for ejecting ink toward a print medium and being movable in a scanning direction substantially orthogonal to a conveyance direction of the print medium, the at least two print heads being arranged in the scanning direction in such a manner that a time of ink ejection from at least one of the print heads is different from a time of ink ejection of at least another one of the print heads, and a nozzle interval between an adjacent pair of print heads of the at least two print heads has a value that is different from a product of the inverse number of a print resolution and any natural number.

2. The print head assembly according to claim 1, wherein the nozzle interval between an adjacent pair of print heads of the at least two print heads has a value that is differentiated from a product of a natural number and the inverse number of the resolution, by the inverse number of a product of the print resolution and a natural number other than 1.

3. The print head assembly according to claim 2, wherein said natural number other than 1 is a number equal to the number of the print heads.

4. The print head assembly according to claim 3, wherein the print heads include at least three print heads that eject color inks that are different from one print head to another.

5. The print head assembly according to claim 4, wherein the nozzle intervals between each adjacent pair of print heads of the at least three print heads are equal.

6. A print head assembly comprising:

print head means for printing with at least two print heads; and nozzle means for ejecting ink toward a print medium and being movable in a scanning direction substantially orthogonal to a conveyance direction of the print medium, wherein the at least two print heads are arranged in the scanning direction in such a manner that a time of ink ejection from at least one of the print heads is different from a time of ink ejection of at least another one of the print heads, and a nozzle interval between an adjacent pair of print heads of the at least two print heads has a value that is different from a product of the inverse number of a print resolution and any natural number.

7. The print head assembly according to claim 6, wherein the nozzle interval between an adjacent pair of printheads of the at least two print heads has a value that is differentiated from a product of a natural number and the inverse number of the resolution, by the inverse number of a product of the print resolution and a natural number other than 1.

8. The print head assembly according to claim 7, wherein said natural number other than 1 is a number equal to the number of the print heads.

9. The print head assembly according to claim 8, wherein the print heads include at least three print heads that eject color inks that are different from one print head to another.

10. The print head assembly according to claim 9, wherein the nozzle intervals between each adjacent pair of print heads of the at least three print heads are equal.

11. A printer apparatus, comprising:

a print head assembly including at least two print heads each having at least one nozzle for ejecting ink toward a print medium and being movable in a scanning direction substantially orthogonal to a conveyance direction of the print medium, the at least two print heads being arranged in the scanning direction in such a manner that a time of ink ejection from at least one of the print heads is different from a time of ink ejection of at least another one of the print heads; and a control system for conveying the print heads in the scanning direction and driving at least one and another print head at each of the scans.

12. The printer apparatus according to claim 11, wherein a nozzle interval between an adjacent pair of print heads of the at least two print heads has a value that is different from a product of the inverse number of a print resolution and any natural number.

13. The printer apparatus according to claim 12, wherein the nozzle interval between an adjacent pair of print heads of the at least two print heads has a value that is differentiated from a product of a natural number and the inverse number of the resolution, by the inverse number of a product of the print resolution and a natural number other than 1.

14. The printer apparatus according to claim 13, wherein said natural number other than 1 is a number equal to the number of the print heads.

15. The printer apparatus according to claim 14, wherein the print heads include at least three print heads that eject color inks that are different from one print head to another.

16. The printer apparatus according to claim 15, wherein the nozzle intervals between each adjacent pair of print heads of the at least three print heads are equal.

* * * * *